United States Patent [19]

Taniishi et al.

[11] 4,291,505

[45] Sep. 29, 1981

[54] PROCESS FOR PRODUCING NEGATIVE-CROWNED ROLLER

[75] Inventors: Shinnosuke Taniishi, Kawasaki; Tsukasa Kuge, Tokyo, both of Japan

[73] Assignee: Canon Kabushiki Kaisha, Tokyo, Japan

[21] Appl. No.: 79,081

[22] Filed: Sep. 26, 1979

[30] Foreign Application Priority Data

Oct. 2, 1978 [JP] Japan ..... 53-121335

[51] Int. Cl.[3] ..... B24B 1/00; B24B 5/16

[52] U.S. Cl. ..... 51/289 R; 51/49

[58] Field of Search ..... 51/49, 289 R; 29/148.4 D

[56] References Cited

U.S. PATENT DOCUMENTS

| | | | |
|---|---|---|---|
| 2,106,215 | 1/1938 | Hutchens | 51/49 |
| 2,766,559 | 10/1956 | Pixley | 51/289 R X |
| 3,088,250 | 5/1963 | Hold | 51/49 |
| 3,398,489 | 8/1968 | Rohrer | 51/49 X |
| 3,469,353 | 9/1969 | Klein | 51/49 X |

*Primary Examiner*—Gary L. Smith

*Attorney, Agent, or Firm*—Fitzpatrick, Cella, Harper & Scinto

[57] ABSTRACT

The disclosure provides a process for producing a negative-crowned roller having a progressively decreasing diameter from both ends toward the center thereof by means of a one-dimensional mutual displacement between the raw material of the roller and the shaping tool.

9 Claims, 9 Drawing Figures

PROCESS FOR PRODUCING NEGATIVE-CROWNED ROLLER

BACKGROUND OF THE INVENTION

1. Field of the Invention

The present invention relates to a process for producing a negative-crowned roller.

2. Description of the Prior Art

For example in an electrophotographic apparatus, for the purpose of fixing a toner image onto a support material such as plain paper there is commonly employed a roller fixing apparatus in which the support material having an unfixed toner image is supplied to and advanced between at least a pair of rollers maintained in mutual pressure contact. Such roller fixing apparatus utilizes for example the thermal fixing process wherein at least one of said paired rollers is heated for melt-fixing said toner onto the support material or the pressure fixing process wherein said paired rollers are mutually pressed with a linear pressure of 10 kg/cm or higher by which the toner image is fixed onto said support material. In these processes there should be provided a suitable measure for preventing wrinkle formation on the support material during the advancement thereof between the paired rollers, and for this purpose it is already known to shape either or both of said paired rollers in the form of roller 1 shown in FIG. 1, said form having a negative crowning in which the diameter, contrary to the so-called crowning, progressively decreases from the both ends towards the center of the roller. Such roller, in cooperation with an ordinary straight roller or a similar negative-crowned roller, exerts on the support material to be advanced between said rollers an extending force in the transversal direction of said support material (i.e. a direction parallel to the axial direction of said rollers or perpendicular to the advancing direction of said support material) from the center toward the lateral edges of the support material, thereby preventing the wrinkle formation thereon. Said negative-crowned roller is preferably elastically deformable at least at the surface portion thereof so as to be in intimate contact with the other of the paired rollers when maintained in pressure contact therewith. In the above-explained fixing apparatus, therefore, there is preferred the use of a rubber roller composed of a metal core covered with a silicone rubber layer of which peripheral surface is shaped into the negatively crowned form. The silicone rubber is also useful for preventing the offsetting of the toner.

In order to prepare such a negative-crowned roller as explained above, it has been necessary to move the support of a grinding roller in a direction parallel to the axis of the roller to be ground and simultaneously to move the grinding roller itself in the radial direction of the roller to be ground along a curved trajectory. Naturally it is alternatively possible to move the roller to be ground in the corresponding directions to achieve such mutual movements, but in any case a two-dimensional movement has to be made either by the grinding roller or by the roller to be ground, thus requiring a complicated working process and device, eventually resulting in a deteriorated precision and an elevated manufacturing cost.

Though such negative-crowned roller can also be prepared inexpensively by solidifying a liquid material in a female mold for such roller, it is difficult to obtain a smooth roller surface with an enough precision. The negative-crowned roller to be employed in the toner image fixing apparatus, however, is required to have satisfactorily high dimensional precision and surface smoothness, and also to be reasonably inexpensive.

SUMMARY OF THE INVENTION

The object of the present invention is to provide a process for producing a negative-crowned roller by one-dimensional mutual displacement between the material to be ground and the grinding tool.

Another object of the present invention is to provide a process for producing a negative-crowned roller with a satisfactorily high dimensional precision.

Still another object of the present invention is to provide a process for inexpensively producing a negative-crowned roller.

Still another object of the present invention is to provide a process for producing a negative-crowned roller provided with a smooth surface.

Still another object of the present invention is to provide a process allowing inexpensive and easy production of a negative-crowned roller of a satisfactorily high dimensional precision and provided with a smooth surface adapted for use in a toner image fixing apparatus.

Still other objects and advantages of the present invention will become apparent from the following description.

DESCRIPTION OF THE PREFERRED EMBODIMENTS

Figure 1:
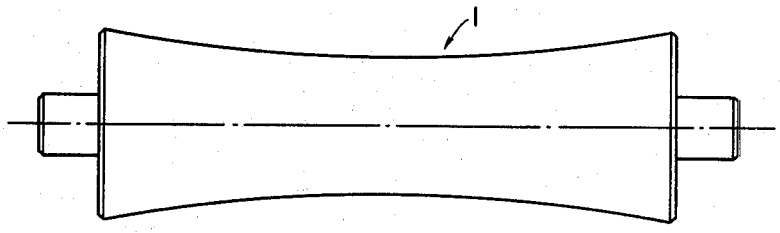
FIG. 1 is a schematic view of a negative-crowned roller to be employed in a toner image fixing apparatus.
Figure 2A:
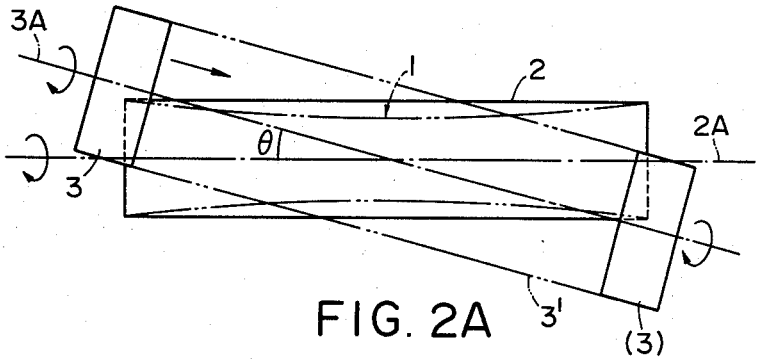
FIG. 2A is an elevation view of an embodiment of the present invention.
Figure 2B:
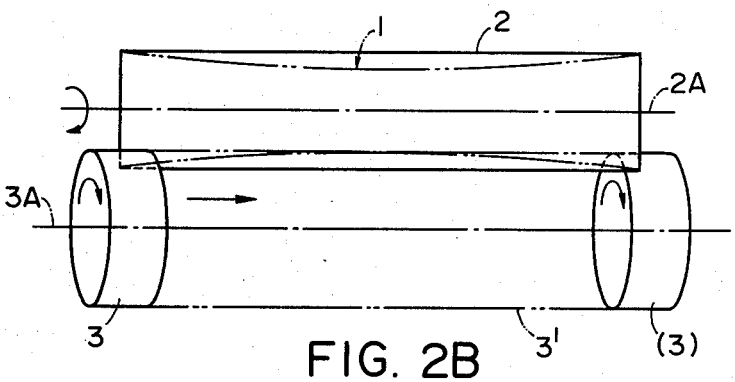
FIG. 2B is a plan view of said embodiment.
Figure 2C:
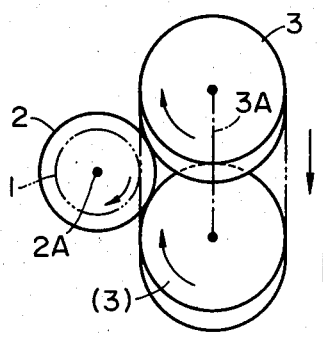
FIG. 2C is a lateral view of said embodiment.

In FIGS. 2A, 2B and 2C there is shown an unground roller 2 composed for example of a metal core covered with a silicone rubber layer which is to be finished as a pressure roller (to be maintained in contact with the back side of the toner image support material for pressing the toner image carrying surface against a rigid heat roller) for use in a heat roller fixing apparatus. Prior to the grinding said roller 2 is provided with an ordinary cylindrical form.

Said roller 2 is maintained in rotation at a fixed position and about the central axis 2A thereof.

A grindstone roller 3 is positioned in such a manner that the central axis 3A thereof is in a geometrical twist position with a small angle $\theta$ ($\theta>0$) with respect to the central axis 2A of the roller 2. As shown in FIGS. 2A, 2B and 2C the central axis 2A and 3A have a common perpendicular line at the center of the axial length of the desired negatively crowned portion. The position of said common perpendicular shall be called the crossing position of the central axes, where the distance between the central axes 2A and 3A is smallest and at which the mininum diameter of the negative-crowned roller is obtained in the manner to be explained later.

The grindstone roller 3 may have an arbitrary axial length which may therefore be shorter or longer than or equal to the axial length of the negative-crowned roller to be formed. However the use of a grindstone roller 3 shorter than the negative-crowned roller to be formed as shown in FIGS. 2A, 2B and 2C is effective for rendering the working device compact.

The grinding operation is initiated by bringing the peripheral surface of the grindstone roller 3 into contact with an end of the axial length of the roller 2, while said grindstone roller 3 is maintained in rotation in the same direction as that of the roller 2 or in the opposite direction but with a peripheral speed different from that of the roller 1 to be formed. In the illustrated case the rollers 2 and 3 are rotated in the same direction. The grinding of the peripheral surface of the roller 2 is so achieved that, while the rollers 2, 3 are rotated in the above-explained manner, a linear displacement of the roller 3 along the axial direction 3A thereof, i.e. along a direction inclined with respect to the axis 2A of the roller 2, until the roller 3 reaches a position (3) at the other end of the roller 2. The chain lines 3' indicate the straight cylindrical displacing trajectory of the grinding roller 3. Said displacement of the roller 3 causes the grinding of the peripheral surface of the roller 2, thus forming a negative-crowned roller 1. Since the amount of grinding at the center of the roller 2 differs from that at both ends thereof, it is desirable to progressively decrease the displacing speed of the grinding roller 3 from an end of the roller 2 to the center thereof and to progressively increase said speed in the symmetrical manner from said center to the other end of said roller 2, or to progressively increase the peripheral speed difference between the rollers 2 and 3 during the displacement of the roller 3 from the end of the roller 2 to the center thereof and to progressively decrease said speed difference in the symmetrical manner during the displacement of the roller 3 from said center to the other end of the roller 2. It is also possible to use the above-explained two methods in combination. On the other hand the grinding can be achieved with the displacement of the roller 3 at a constant speed and with a constant peripheral speed difference between the rollers 2 and 3 in case the amount of negative crowning (the difference between the maximum and minimum diameters) is sufficiently small or the roller 2 is made or a soft material such as silicone rubber.

Although in the embodiment shown in FIGS. 2A, 2B and 2C the roller to be ground 2 is rotated at a fixed position while the grindstone roller 3 is displaced along the axial direction thereof, it is also possible to maintain the grindstone roller 3 in rotation at a fixed position and to displace the roller to be ground 2 in a linear direction which is in a geometrical twist position with respect to the axis 3A of said roller 3 in such a manner that said roller 2 is brought into contact from an end to the other end thereof progressively with said roller 3. In such case the foregoing explanation applies similarly to the linearly displacing speed of the roller 2 and/or the speed difference between the rollers 2 and 3.

The roller 3 shown in FIGS. 2A, 2B and 2C is of a straight cylindrical form. However, in the aforementioned methods of the present invention wherein a relative linear displacement of the roller 3 is created in a direction inclined with respect to the axis 2A of the roller 2, the grindstone roller 3 may also be of a crowned form wherein the central diameter is larger than the diameter at the ends thereof or of a conical form, the geometrical center of said roller coinciding with the rotary axis thereof. Furthermore, although in FIGS. 2A, 2B and 2C the direction of rotary axis 3A of the roller 3 coincides with the direction of linear displacement thereof with respect to the roller 2, it is also possible to provide a fixed inclination angle between these two directions at least during said relative displacement. In summary the objects of the present invention can be achieved as long as the outermost surface of the trajectory formed by the displacement of the roller 3 relative to the roller 2 is linear along the direction of the above-mentioned relative displacement inclined with respect to the axis 2A of the roller 2.

Figure 3A:
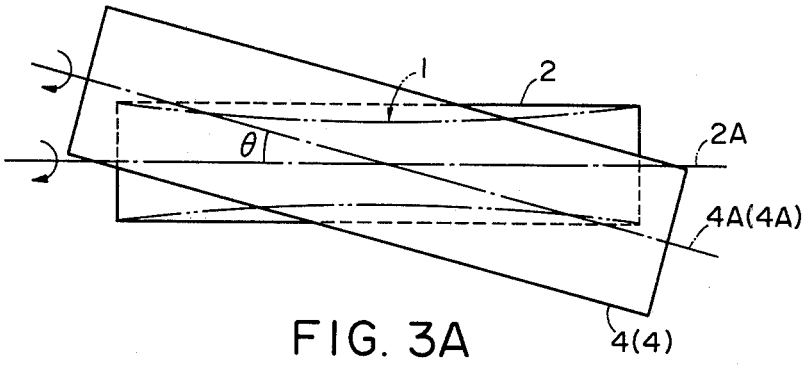
FIG. 3A is an elevation view of another embodiment of the present invention.
Figure 3B:
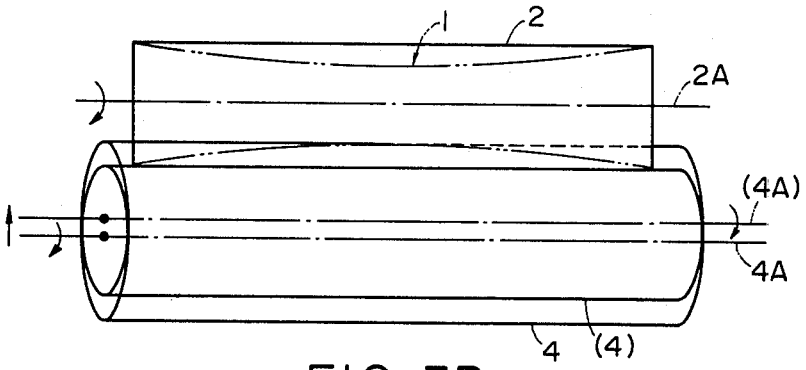
FIG. 3B is a plan view of said embodiment.
Figure 3C:
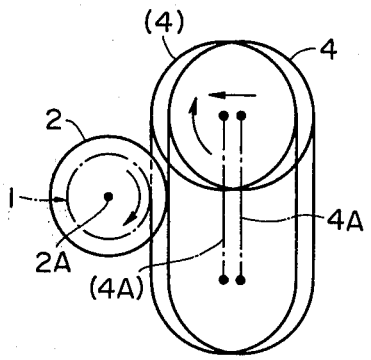
FIG. 3C is a lateral view of said embodiment.

In FIGS. 3A, 3B and 3C there is shown a grindstone roller 4 of which length is in this case in excess of the length of the negatively crowned portion to be formed and of which central axis 4A is in a geometrical twist position with a small angle $\theta$ with respect to the central axis 2A of the roller 2 to be ground. The axes 2A and 4A have a crossing position at the center in the axial length of the roller 2 as shown in FIGS. 3A, 3B and 3C, whereby the roller 2 is ground from an end to the other to form a negative-crowned roller 1 having a minimum diameter at the center in the axial length thereof.

The roller 2 to be ground is rotated at a fixed position, while the grindstone roller 4 is rotated in a direction and at a speed as explained in relation to FIGS. 2A, 2B and 2C.

In the grinding operation of the roller 2, the grindstone roller 4 is brought into contact with the roller 2 both at the center in the axial length of the roller 2 and 4, and the roller 4 is linearly displaced in the radial direction of the roller 2 and toward the center thereof while said rollers 2 and 4 are maintained in rotation in the above-explained manner. (4) and (4A) indicate the positions of the grindstone roller 4 and the central axis 4A at the completion of grinding of the roller 2 into the desired shape by said linear displacement. As the contact area of the roller 4 with the roller 2 progressively increases during the course of said linear displacement for grinding the roller 2 into the negative-crowned roller 1, it is desirable to progressively increase the peripheral speed difference between the rollers 2, 4 or to progressively decrease the displacing speed of the roller 4, or further to combine these methods. It is however possible also to achieve the grinding with the parallel displacement of the roller at a constant speed and with a constant speed difference between the rollers 2 and 4 in case the roller 2 is made of a soft material such as silicone rubber.

Although in FIGS. 3A, 3B and 3C the roller 4 is linearly displaced, it is also possible to maintain the roller 4 in rotation at a fixed position and to linearly displace the roller 2 in the axial direction of the roller 4 and toward the center thereof while said roller 2 is maintained in rotation. In such case the foregoing explanation applies similarly to the linearly displacing speed of the roller 2 and/or to the peripheral speed difference between the rollers 2, 4.

In the foregoing embodiment shown in FIGS. 3A, 3B and 3C wherein the grindstone is rotated, said grindstone roller 4 is preferably of a straight cylindrical form, the geometrical center thereof coinciding with the rotary axis of said roller 4.

Although the grindstone 4 is most preferably formed as a rotating roller as explained in FIGS. 3A, 3B and 3C, it is not essentially necessary to rotate the grindstone 4, and such grindstone can therefore assume other forms. In summary the objects of the present invention can be achieved if the grindstone 4 is provided in a particular direction (axial direction in case of a roller) with a linear grinding portion (thus a straight cylindrical form in case of a roller) and is brought into contact with the roller 2 in such a manner that said linear portion is inclined with respect to the rotary axis of said roller 2 to be ground.

Similarly, in the embodiment shown in FIGS. 2A, 2B and 2C, the grindstone 3, though most preferably in a form of rotating roller, need not necessarily rotate and may therefore assume forms other than a roller. Also in this case the objects of the present invention can be achieved if the grindstone 3 is linearly displaced, while it is maintained in contact with the roller 2, in a direction inclined with respect to the axis of said roller 2.

Also the roller 2 to be ground is preferably shaped preliminarily into a straight cylindrical form or a form close to the desired negatively crowned form prior to the grinding with the grindstone 3 or 4, but the roller 2 may also assume other forms for example a crowned roller form. In either case the rotary axis of said roller 2 is preferably made to coincide with the geometrical center thereof from the start of the grinding with the grindstone 3 or 4.

Now there will be given a theoretical analysis on the process of the present invention while making reference to FIGS. 4 and 5.

A basic form of negative crowning is given by the following equation:

$$r^2 = r_o^2 + x^2 \tan^2\theta \quad (1)$$

wherein r is the radius of the negative-crowned roller at an axial distance x from the center thereof, $r_o$ is the minimum radius of the negative-crowned roller at the center in the axial center thereof (x=0), and $\theta$ is the twist angle between the central axis of the negative-crowned roller or the roller to be ground and the grinding line or the contact line between the roller to be ground and the grindstone roller, said line being parallel to the central axis of the grindstone roller.

Figure 4:
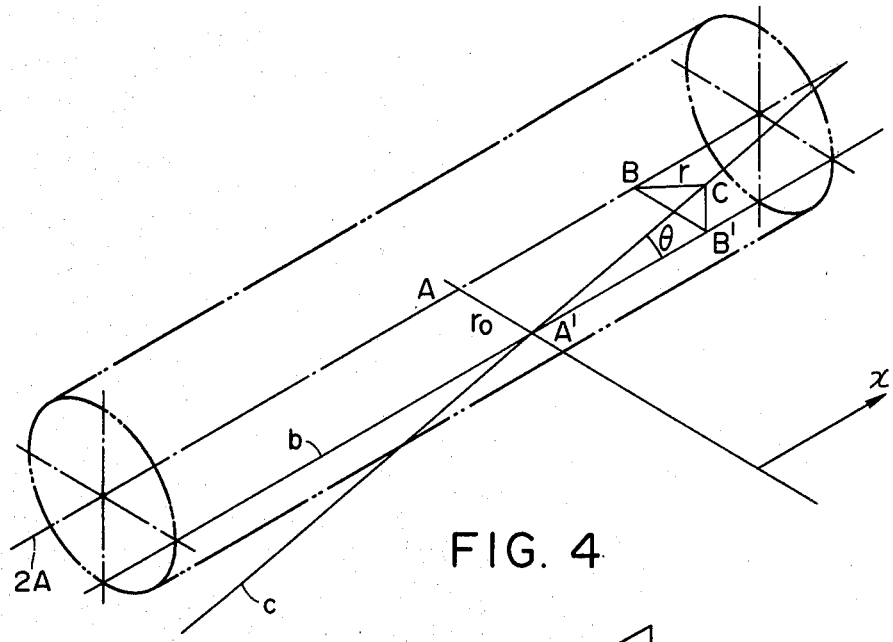
FIGS. 4 and 5 are reference drawings for the analysis of the roller form.

In FIG. 4, there is considered an imaginary cylinder having the axis at the axis 2A of the roller 2 and having as the generator a line b which is parallel to said axis 2A and spaced by a distance $r_o$ therefrom, and there is also considered a line c present in a plane tangential to said imaginary cylinder and forming an angle to said axis 2A. Said line c is tangential to the desired negatively crowned surface. Taking the distance between the axis 2A and the line b at a distance x from the axial center of the roller as BB′ and the distance from the point B′ to the point C on the line c lying on the negatively crowned surface at the same distance x as B′C=r:

$$BB' = r_o,\ B'C = r \quad (2)$$

Referring to FIG. 4, and in the triangle A′B′C:

$$B'C = x \tan \quad (3)$$

Also in the triangle BB′C:

$$BB'^2 + B'C^2 = BC^2 \quad (4)$$

By inserting the equations (2) and (3) into the equation (4):

$$r^2 = r_o^2 + x^2 \tan^2\theta$$

to obtain the equation (1) representing the hyperbolic form of the negative-crowned roller.

In the actual roller grinding there should be considered the radius of the grindstone roller. Thus the foregoing equation will be explained in the following with reference to FIG. 5.

Figure 5:
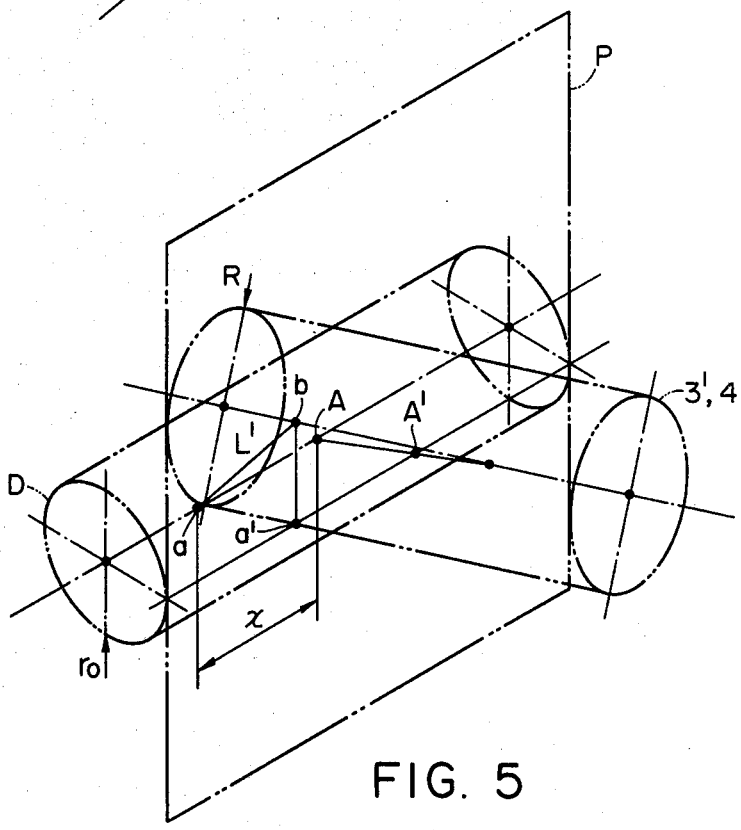

In FIG. 5 there are shown an imaginary plane P tangential to a cylinder D of a radius $r_o$ which is equal to the minimum radius of the negative-crowned roller to be formed, and a grindstone roller 4 or a displacing trajectory 3′ of a grindstone roller 3 of a radius R which is positioned opposite to said cylinder D with respect to the plane P and tangential to said cylinder D at the center A′ in the axial length thereof, forming an angle $\theta$ to a plane containing the axis of said cylinder D and said tangential point A′.

The radius $r_x$ of the roller before the grinding can be obtained by determining the distance ab from the axis A of the cylinder D to the axis of the grindstone 4 or of said trajectory at a distance x equal to the half length of the roller from the center thereof and subtracting therefrom the radius R of the grindstone. Taking ab=L:

$$L = \sqrt{(R + r_o)^2 + x^2\tan^2\theta} \quad (5)$$

thus:

$$L^2 = (R + r_o)^2 + x^2\tan^2\theta \quad (6)$$

This equation represents a hyperbola with the following asymptotes:

$$L = -x \tan\theta \text{ and } L = x \tan\theta$$

The original radius of the roller to be ground is determined by subtracting the radius R of the grindstone from the value of L obtained from the equation (5). Thus:

$$r_x = \sqrt{(R - r_o)^2 - x^2\tan^2\theta} - R \quad (7)$$

In practice the length of the negative-crowned roller, the difference in radius between the center and the both ends thereof and the central radius of said negative-crowned roller are given by the purpose of use of said roller. In the equation (6) the factors L, R, r and x are determined by suitably selecting the radius of the grindstone roller, and it is thus rendered possible to determine the value of $\theta$.

In case the roller to be ground is composed of an elastic material, particularly rubber, the shape of the negative-crowned roller actually formed does not exactly coincide with the shape represented by the foregoing equation because of inevitable elastic deformation resulting from the contacting pressure of the grindstone roller. However such deformation is practically not a trouble since it is possible to obtain a roller having diameter progressively decreasing from both ends toward the center thereof.

Although in the foregoing explanation the axes of the grindstone roller and the roller to be ground are positioned to have a crossing point at the axial center of said roller to be ground, an almost similar result can be obtained if said crossing point is positioned close to an end of said roller to be ground since the angle between said axes is very small.

What we claim is:

1. A process for producing a negative-crowned roller, which comprises:

maintaining a grinding tool in contact with a cylindrical-form material to be ground;

maintaining said material in rotation; and linearly displacing said grinding tool relative to said material to be ground along a direction inclined with respect to the rotary axis of said material to be ground to produce the negative crowned roller surface thereon.

2. A process according to claim 1, wherein said grinding tool is provided with a grinding portion of a length shorter than the length of the negative-crowned roller to be formed.

3. A process according to claim 1, wherein said grinding tool is formed as a roller and is maintained in rotation while in said contact with said material to be ground.

4. A process according to claim 3, wherein the rotary axis of said grinding tool is aligned in the direction of said relative linear displacement.

5. A process for producing a negative-crowned roller, which comprises:

maintaining a grinding tool provided with a linear grinding portion in contact with a cylindrical-form material to be ground in such a manner that the rotary axis thereof is inclined with respect to the linear direction of said tool;

maintaining said material to be ground in rotation; and linearly displacing said grinding tool relative to said material to be ground along the radial direction thereof to produce the negative crowned roller surface thereon.

6. A process according to claim 5, wherein said grinding tool is provided with a length longer than the length of the negative-crowned roller to be formed.

7. A process according to claim 6, wherein said grinding tool is a roller of a straight cylindrical form and is maintained in rotation while in said contact with the material to be ground.

8. A process according to claim 3, 4, or 7, wherein said material to be ground is a rubber roller.

9. A process according to claim 3, 4, 5 or 7 for producing a negative-crowned roller wherein said material comprises a material for fixing a toner image.

* * * * *